US007328479B2

(12) United States Patent
Willenbring

(10) Patent No.: US 7,328,479 B2
(45) Date of Patent: Feb. 12, 2008

(54) LIGHTING APPARATUS FOR A VACUUM CLEANER

(75) Inventor: Charles Donald Willenbring, Webster City, IA (US)

(73) Assignee: Electrolux Home Care Products Ltd., Cleveland, OH (US)

( * ) Notice: Subject to any disclaimer, the term of this patent is extended or adjusted under 35 U.S.C. 154(b) by 110 days.

(21) Appl. No.: 11/403,572

(22) Filed: Apr. 13, 2006

(65) Prior Publication Data

US 2007/0240275 A1 Oct. 18, 2007

(51) Int. Cl.
*A47L 9/00* (2006.01)

(52) U.S. Cl. ..... 15/324; 15/319

(58) Field of Classification Search ..... 15/324, 15/398, 339, 319

See application file for complete search history.

(56) References Cited

U.S. PATENT DOCUMENTS

| | | | | |
|---|---|---|---|---|
| 4,656,687 | A | 4/1987 | Wei | |
| 4,757,574 | A | 7/1988 | Sumerau | |
| 4,791,700 | A * | 12/1988 | Bigley et al. | 15/324 |
| 5,107,565 | A | 4/1992 | Chun | |
| 5,207,498 | A | 5/1993 | Lawrence et al. | |
| 5,467,501 | A | 11/1995 | Sepke | |
| 5,575,035 | A | 11/1996 | Reis et al. | |
| 5,896,618 | A | 4/1999 | Woo et al. | |
| 5,983,443 | A | 11/1999 | Redding | |
| 5,987,697 | A | 11/1999 | Song et al. | |
| 6,253,414 | B1 | 7/2001 | Bradd et al. | |
| 6,289,552 | B1 | 9/2001 | McCormick | |
| 6,490,755 | B2 | 12/2002 | Paterson et al. | |
| 6,763,548 | B1 * | 7/2004 | Birle et al. | 15/351 |
| 6,792,645 | B2 | 9/2004 | Ruff | |
| 6,968,593 | B1 * | 11/2005 | Lenkiewicz et al. | 15/320 |
| 2004/0163200 | A1 | 8/2004 | Overvaag et al. | |
| 2004/0255426 | A1 | 12/2004 | Davis et al. | |
| 2005/0115014 | A1 | 6/2005 | Worwag | |
| 2005/0273968 | A1 * | 12/2005 | Seith | 15/339 |
| 2006/0096057 | A1 * | 5/2006 | Chatfield | 15/324 |

* cited by examiner

*Primary Examiner*—Dung Van Nguyen
(74) *Attorney, Agent, or Firm*—Pearne & Gordon LLP

(57) ABSTRACT

A lighting device for a vacuum cleaner is provided with a cleaning attachment, a housing adapted to attach to the cleaning attachment, and at least one lighting device. The lighting device is further provided with an electric circuit including a battery and a switch operably connected to the battery and the lighting device to regulate electric current between the battery and the lighting device. The lighting device includes a timing device adapted to deactivate the lighting device after a predetermined amount of time after activation by the switch.

7 Claims, 7 Drawing Sheets

LIGHTING APPARATUS FOR A VACUUM CLEANER

FIELD OF THE INVENTION

The present invention relates generally to a lighting apparatus for a vacuum cleaner, and more specifically to a lighting apparatus for a cleaning attachment.

BACKGROUND OF THE INVENTION

Vacuum cleaners commonly include attachments for specific cleaning environments. For example, vacuum cleaners are known to include various nozzles, brushes, powered attachments, or the like. Attachments for vacuum cleaners are known to include a lighting device configured to illuminate adjacent areas to be cleaned.

It is known to power the lighting device with the same source used to power the vacuum motor of the vacuum cleaner. Such lighting devices are known to turn on and off together with the vacuum motor. It is also known to power the lighting device with a battery. Known battery powered lighting devices require the user to manually activate and deactivate the lighting device to preserve battery life. There is a continuing need in the art for an improved lighting apparatus for use with cleaning attachments of a vacuum cleaner.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a lighting apparatus for a vacuum cleaner is provided with a cleaning attachment, a housing adapted to attach to the cleaning attachment, and at least one lighting device adapted to be received by the housing. The lighting apparatus further includes an electric circuit adapted to be received by the housing. The electric circuit includes a battery and a switch operably connected to the battery and the lighting device to regulate electric current between the battery and the lighting device. The electric circuit includes a timing device adapted to deactivate the lighting device after a predetermined amount of time after activation by the switch.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
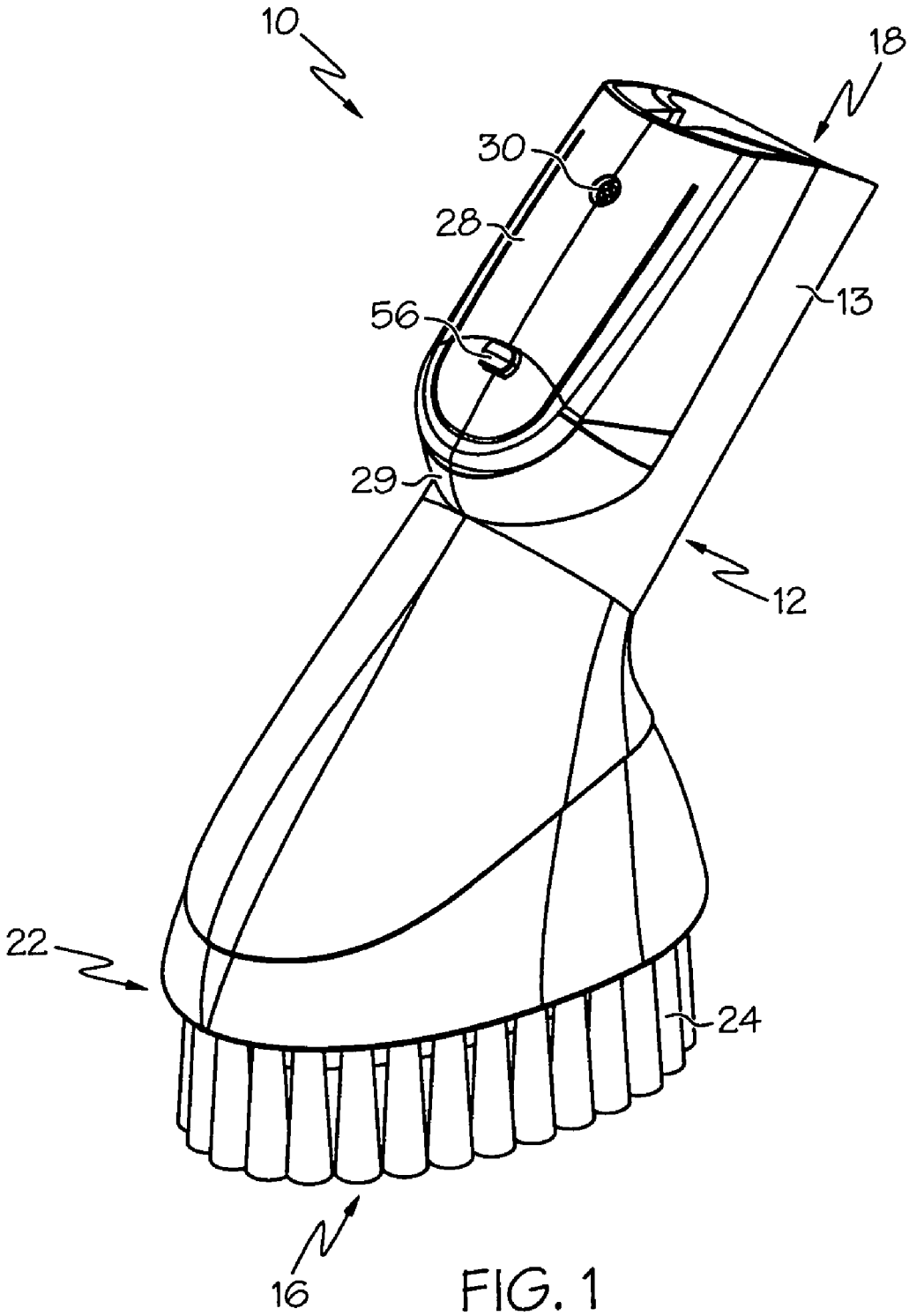
FIG. 1 is a perspective view of an example lighting apparatus attached to a cleaning attachment for a vacuum cleaner.

Example embodiments of a lighting apparatus that incorporate aspects of the present invention are shown in the drawings. It is to be appreciated that the shown examples are not intended to be a limitation on the present invention. For example, one or more aspects of the present invention can be utilized in other embodiments and even other types of lighting apparatus.

Turning to the shown example of FIG. 1, an example lighting apparatus 10 for a vacuum cleaner is shown. As shown, the lighting apparatus 10 comprises a cleaning attachment 12. The cleaning attachment 12 is adapted to connect to a vacuum cleaner 14 (see FIG. 5) to clean by vacuuming debris (e.g., by suction) from an area, surface and/or object. For example, the cleaning attachment 12 can include a vacuum inlet 16 adapted to receive the debris. In addition, the cleaning attachment 12 can include a vacuum outlet 18 in fluid communication with the vacuum inlet 16. The vacuum outlet 18 can be adapted to removably connect to a hose 20 of the vacuum cleaner 14 (see FIG. 5) to thereby transfer the debris to a storage unit (e.g., a vacuum bag or canister, not shown) connected to the vacuum cleaner 14. The vacuum outlet 16 can connect to the hose 20 in any manner that provides a fluid communication between the cleaning attachment 12 and the vacuum cleaner 14. For example, as shown, the vacuum outlet 18 can include female/male structure adapted to receive, and/or be received by, a corresponding male/female structure of a vacuum hose 20. The connection between the cleaning attachment 12 and the vacuum cleaner 14 can be removably secured in various ways. For example, the connection may be secured by an interference fit, a snap fit, adhesives, and/or fasteners, or the like. It is to be appreciated that vacuum cleaner 14 can be of any type, such as, for example, an upright, canister, or central vacuum, and it can be adapted to receive any type of gas, liquids, and/or solids, such as, for example, air, debris, and/or water.

Figure 2A:
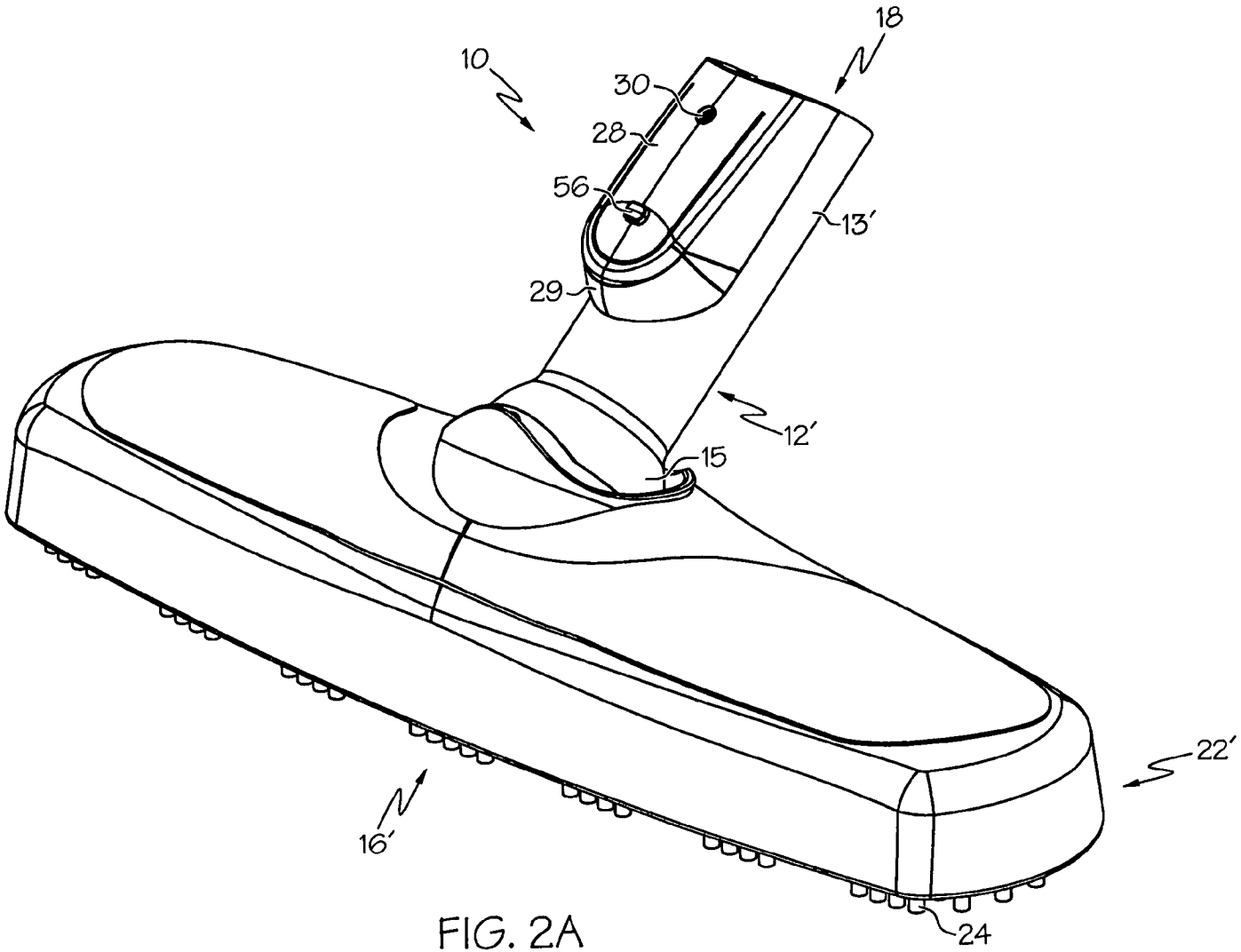
FIG. 2A is a perspective view of the lighting apparatus of FIG. 1 attached to another cleaning attachment.
Figure 2B:
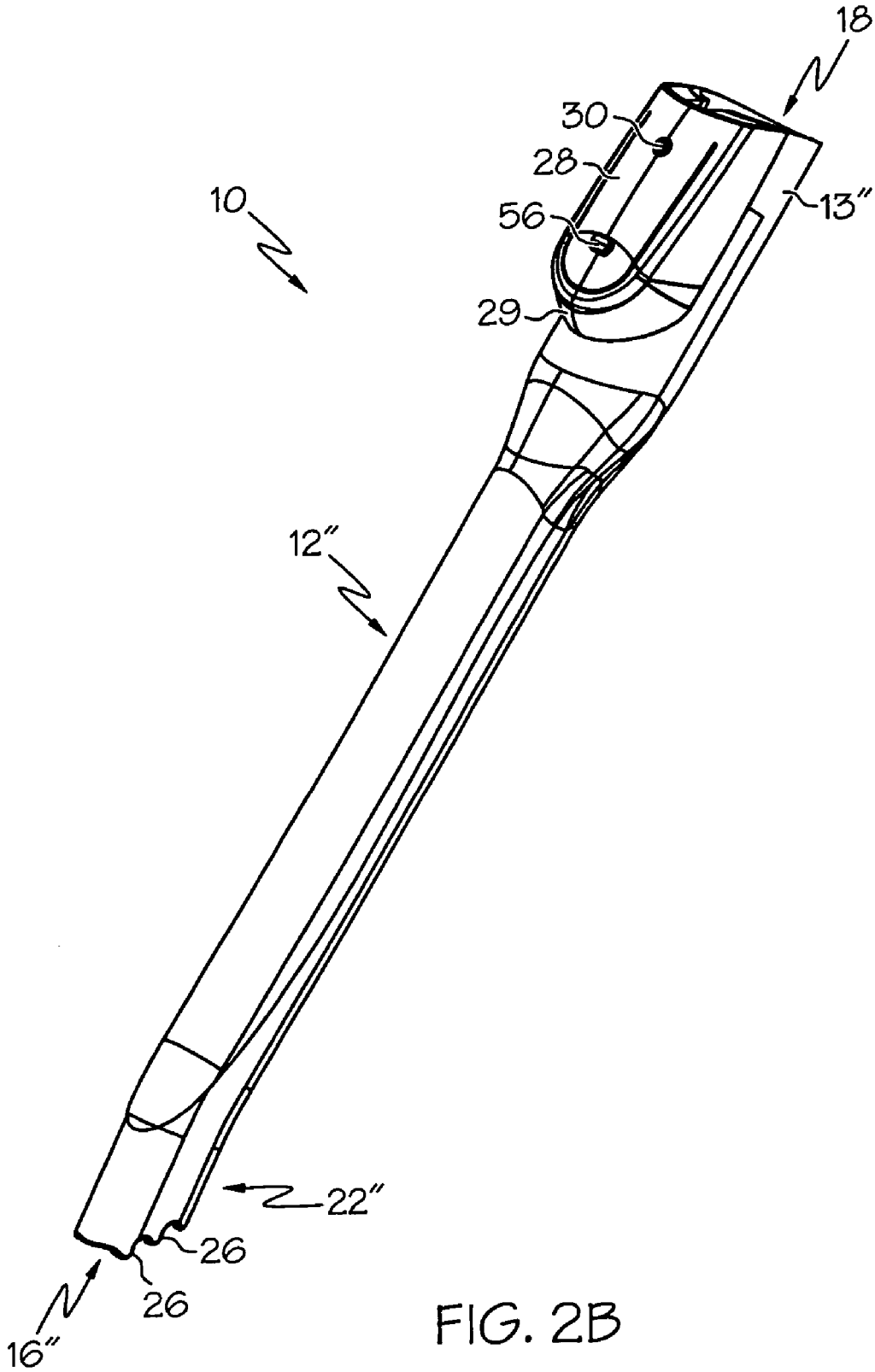
FIG. 2B is a perspective view of the lighting apparatus of FIG. 1 attached to yet another cleaning attachment.

As shown in FIGS. 1, 2A and 2B, the lighting apparatus 10 can be used with various types of cleaning attachments 12, 12', 12", although other types of cleaning attachments may be used in further examples. As shown in FIG. 1, the lower portion 22 of the cleaning attachment 12 has a relatively small profile adapted to provide a relatively small vacuum inlet 16 for cleaning small areas, surfaces and/or objects, such as, for example, upholstery. As shown in the example of FIG. 2A, the lower portion 22' of a another example cleaning attachment 12' has a relatively wide profile adapted to provide a relatively wide vacuum inlet 16' for cleaning large areas, surfaces and/or objects, such as, for example, floors. As shown in FIG. 2B, the lower portion 22" of still another example cleaning attachment 12" has a relatively narrow profile adapted to provide a relatively narrow vacuum inlet 16" for cleaning narrow areas, surfaces and/or objects, such as, for example, crevices or other hard to reach areas.

Each cleaning attachment 12, 12', 12" can include a neck portion 13, 13', 13" defining the vacuum outlet 18. The neck portion 13, 13', 13" can be fixed or movable. For example, as shown in FIGS. 1 and 2B, the neck portions 13, 13" can be fixed such that they cannot move relative to the lower portions 22, 22". In another example, as shown in FIG. 2A, the neck portion 13' can be movable relative to the lower portion 22' through a joint, such as, for example, a pivot joint, a combination of pivot joints 15, a ball-and-socket joint, or the like. It is to be appreciated that any type and/or number of joints can be used to provide relative movement of the neck portion 13, 13', 13" about any number of degrees of freedom.

The cleaning attachments 12, 12', 12" can also include additional structure adapted to help capture debris. For example, as shown in FIG. 1, the cleaning attachment 12 can be provided with a plurality of bristles 24. The bristles 24 can have any length and/or stiffness. As shown, for example, the bristles 24 can have a relatively long length to provide pliable bristles. In another example, as shown in FIG. 2A, the bristles 24 can have a relatively short length to provide stiff bristles. Further still, as shown in FIG. 1, the bristles 24 can be arranged in a substantially continuous manner about the lower portion 22, or, as shown in FIG. 2A, the bristles can be arranged in a non-continuous or staggered manner about the lower portion 22'.

Figure 3:
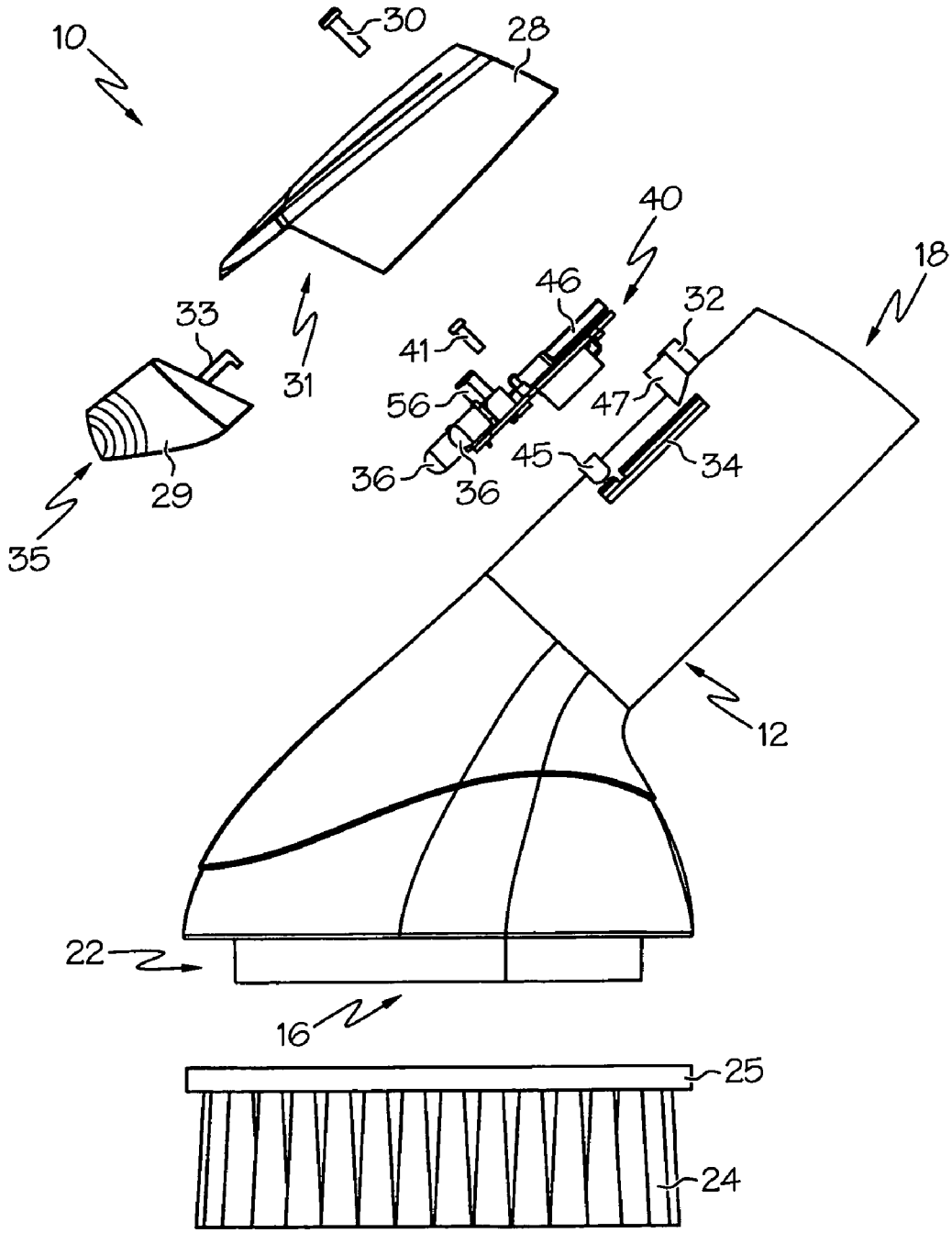
FIG. 3 is a side, exploded view of the lighting apparatus and cleaning attachment of FIG. 1.

In addition or alternatively, the cleaning attachments 12, 12', 12" can also include a plurality of rigid and/or flexible protrusions 26, discussed more fully below. Even further still, the bristles 24 can be adapted to be detachable from the cleaning attachment 12, 12', 12" such that a user could selectively interchange different bristles 24 for different cleaning tasks. For example, as shown in FIG. 3, the bristles 24 can be attached to a mounting block 25 that is adapted to removably attach to the lower portion 22, 22', 22" of the cleaning attachment 12, 12', 12". The mounting block 25 can removably attach to the cleaning attachment 12, 12', 12" in various ways. For example, the mounting block 25 can attach by an interference fit, a snap fit, fasteners, a semi-permanent adhesive, and/or by another mechanical fastener, such as a hook and loop type fastener, or the like. Alternatively, the bristles 24 can be permanently attached to the cleaning attachment 12, 12', 12", such as by a permanent adhesive or even by being formed with the cleaning attachment 12, 12', 12".

As shown in FIG. 2B, the cleaning attachment 12" can also include a plurality of protrusions 26 adapted to manipulate debris or a surface to be cleaned in a crevice or other hard to reach area. The protrusions can include any material and can be pliable, semi-rigid, and/or rigid. The protrusions can be removably or permanently attached to the cleaning attachment 12". Further still, the cleaning attachments 12, 12', 12" can also include any additional structure adapted to help capture debris. It is to be appreciated that the foregoing description of the example cleaning attachments 12, 12', 12" are exemplary in nature and that various other cleaning attachments may be incorporated with the lighting apparatus 10 of the present invention.

The lighting apparatus 10 can further include a housing 28 adapted to attach to the cleaning attachment 12. The housing 28 can be adapted to attach to, and/or detach from, the cleaning attachment 12 in various ways. For example, the housing may be adapted to attach to existing cleaning attachments with a fastening arrangement. In one example, the fastening arrangement can comprise a removable fastening device configured to removably attach the housing to the cleaning attachment. The removable fastening device, if provided, can comprise a wide range of structures such as a hook and loop type fastener, magnet, clip or other fastening arrangement. In one example, the removable fastening device can comprise a C-shaped clip configured to fasten around a circumference of an existing cleaning attachment. Such fastening devices may allow one or more types of lighting apparatus to be used with different cleaning attachments. For example, a user may select one from a plurality of alternative light apparatus types for use with a selected one of a plurality of alternative cleaning attachments. In another example, a vacuum cleaner may be provided with a kit of different types of cleaning attachments and one or more lighting apparatus. If desired, a user may removably attach the lighting apparatus to a selected one of the cleaning attachments for a particular cleaning operation. It is further contemplated that the kit may only include a single lighting apparatus adapted to be alternatively attached to a selected one of the cleaning attachment if desired. In further examples, each cleaning attachment may be provided with a lighting apparatus attached thereto.

As shown, for example in FIG. 3, the housing 28 can also be removably attached to the cleaning attachment 12 by a fastening arrangement comprising a threaded fastener 30, such as a screw or bolt. The threaded fastener 30 can be received by a corresponding anchor 32 of the cleaning attachment 12. In addition or alternatively, the housing 28 can attach to the cleaning attachment 12 by an interference fit, a snap fit, or the like. Further, the cleaning attachment 12 can include alignment structure 34 adapted to ensure that the housing 28 is properly aligned relative to the cleaning attachment 12. For example, the alignment structure 34 can include protrusions extending from, and/or indentations extending into, the surface of the cleaning attachment 12. As yet another alternative, the fastening arrangement can permit the housing 28 to be fixedly attached to the cleaning attachment 12, such as with an adhesive and/or welding process, or it can even be integrally formed with the cleaning attachment 12.

In addition or alternatively, the lighting apparatus 10 can comprise a light permeable cover 29. The light permeable cover 29 can be adapted to protect the lighting apparatus 10 while also permitting light 21 (see FIG. 5) to be emitted therefrom. For example, the light permeable cover 29 can include any light permeable material, such as, for example, plastic or glass, having any degree of transparency. For example, the light permeable material can be translucent or transparent.

The light permeable cover 29 can be permanently or removably attached to the cleaning attachment 12, a portion of the lighting apparatus 10 and/or the housing 28. For example, as shown in FIG. 3, the lighting apparatus 10 can include a mounting structure 39 including a fastening arrangement (not shown) configured to engage mounting arms 33 of the light permeable cover 29. Thus, the light permeable cover 29 may be mounted to the cleaning attachment 12 by way of the mounting structure 39. In another example, the light permeable cover 29 can be attached to one end 31 of the housing 28 by mounting arms 33 adapted to engage corresponding structure (not shown) of the housing 28. In addition or alternatively, the light permeable cover 29 can be adapted to attach to the cleaning attachment 12, the mounting structure 39 and/or the housing 28 by an interference fit, a snap fit, adhesives, and/or fasteners, or the like. Further still, the light permeable cover 29 can be permanently attached to cleaning attachment 12, the mounting structure 39, or the housing 28, such as, for example, by an adhesive or by being integrally formed with the cleaning attachment 12, the mounting structure 39, or the housing 28.

The light permeable cover 29 can also include other features. For example, the light permeable cover 29 can be adapted to emit a particular color of light, such as through a filter or through pigmentation of the actual cover material. As an additional example, the light permeable cover 29 can comprise a lens 35 adapted to direct a portion of the light 21 (see FIG. 5) emitted by the lighting apparatus 10. For example, the lens 35 can be adapted to concentrate (e.g., as through a convex lens) and/or diverge (e.g., as through a concave lens) the light 21 emitted by the lighting apparatus 10. In further examples, the lens 35 may direct light to the right, left, or center of the cleaning attachment 12, and/or may control the elevation angle of the light with respect to the cleaning surface. It is to be appreciated that the light permeable cover 29 can include any type of lens 35, and can even include a plurality of lenses 35.

Figure 4A:
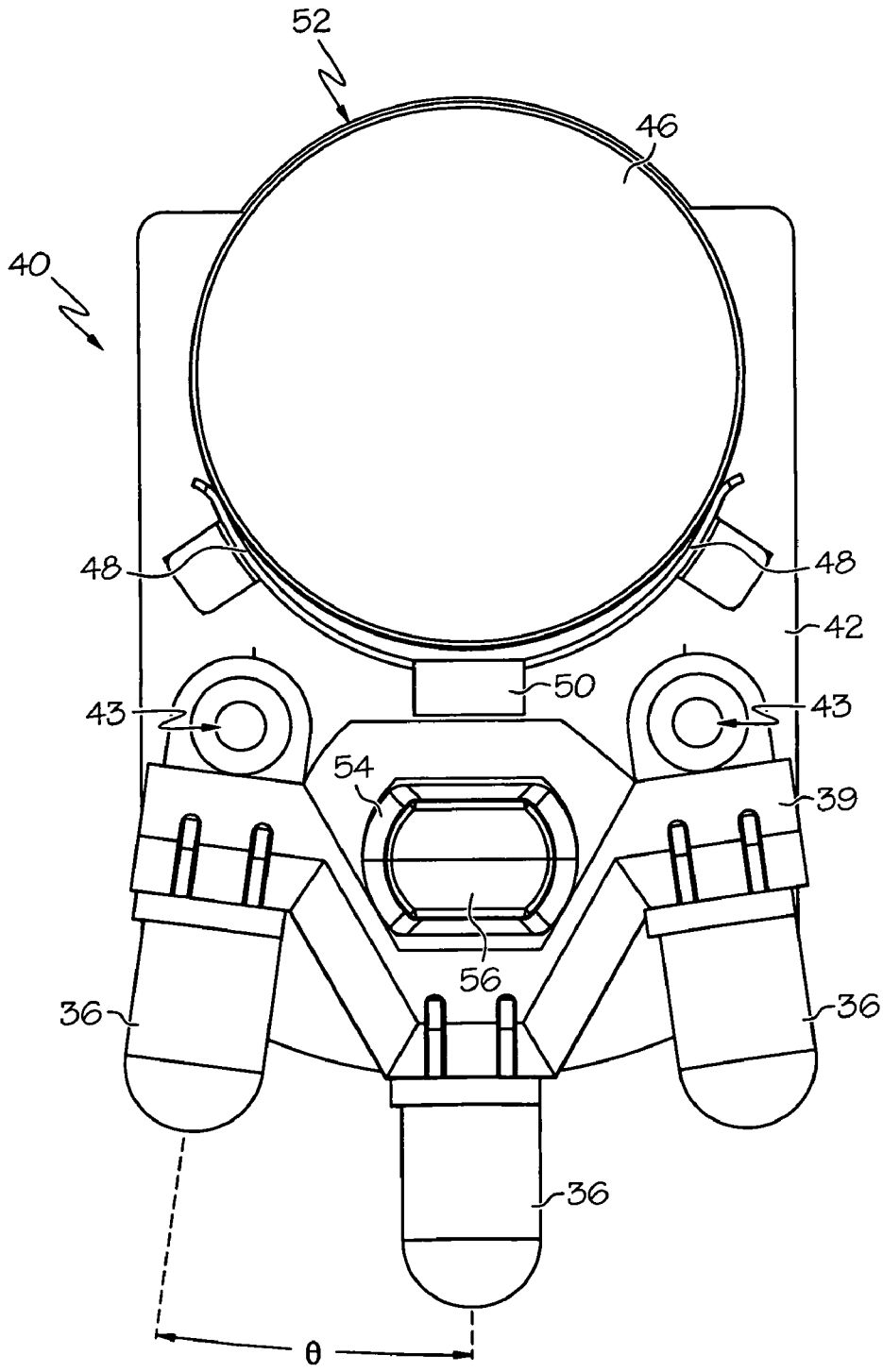
FIG. 4A is a top view of an example electric circuit of the lighting apparatus of FIG. 1.
Figure 4B:
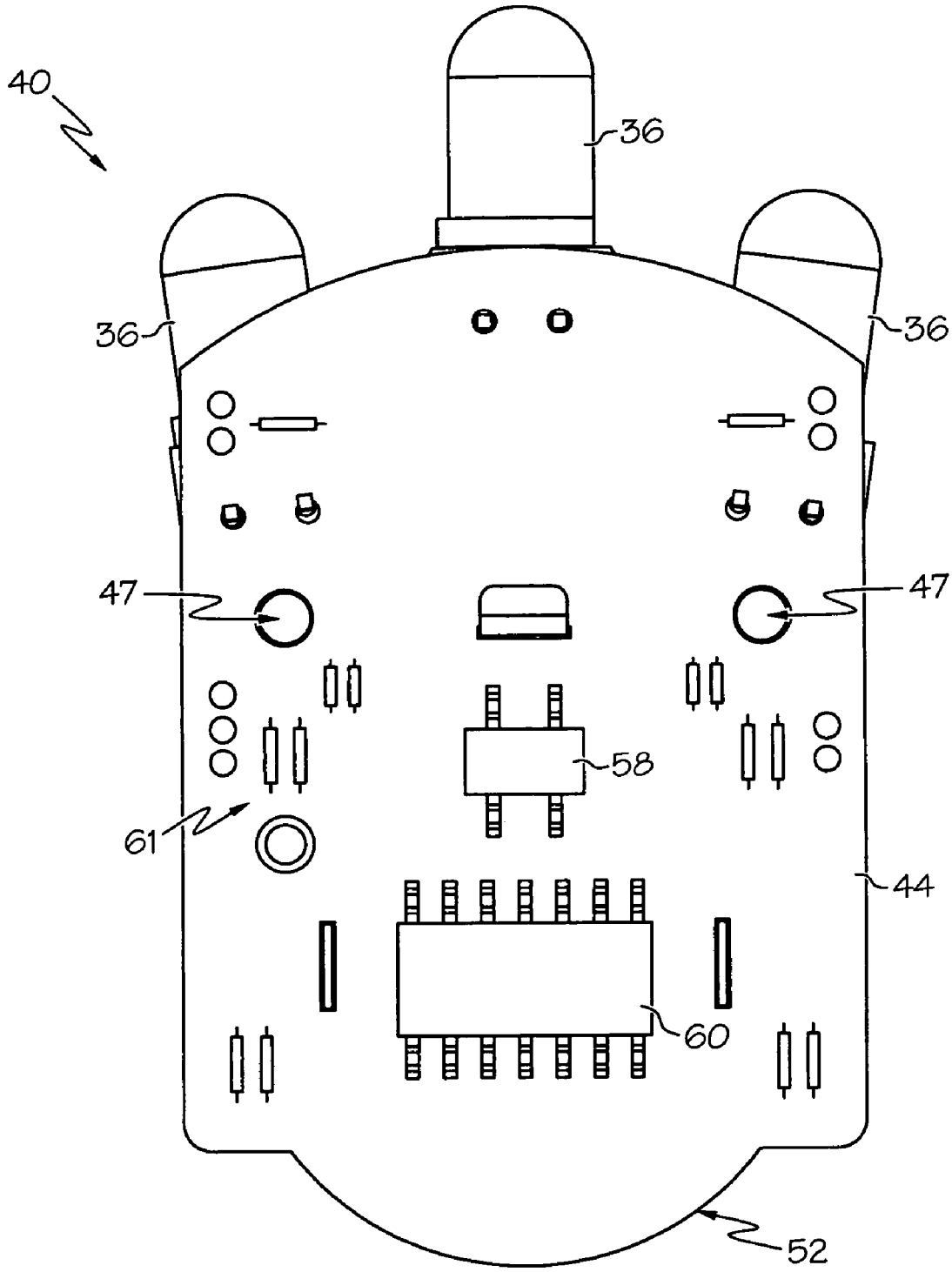
FIG. 4B is a bottom view of the example electric circuit of FIG. 4A.

The lighting apparatus 10 can further include at least one lighting device 36, and can even include a plurality of lighting devices 36. As shown in FIGS. 4A and 4B, the lighting apparatus 10 can include three lighting devices 36, although more or less than three lighting devices 36 may be included in further examples. The lighting devices 36 can comprise any element adapted to emit light 21 (see FIG. 5). As shown in FIG. 4A, for example, one or more lighting devices 36 can comprise light emitting diodes (LEDs). In addition or alternatively, one or more lighting device 36 can comprise any type of light bulb, such as, for example, an incandescent bulb, a fluorescent bulb, and/or a cold cathode bulb. Further still, each lighting device 36 can be adapted to emit light of any intensity and/or color.

Figure 5:
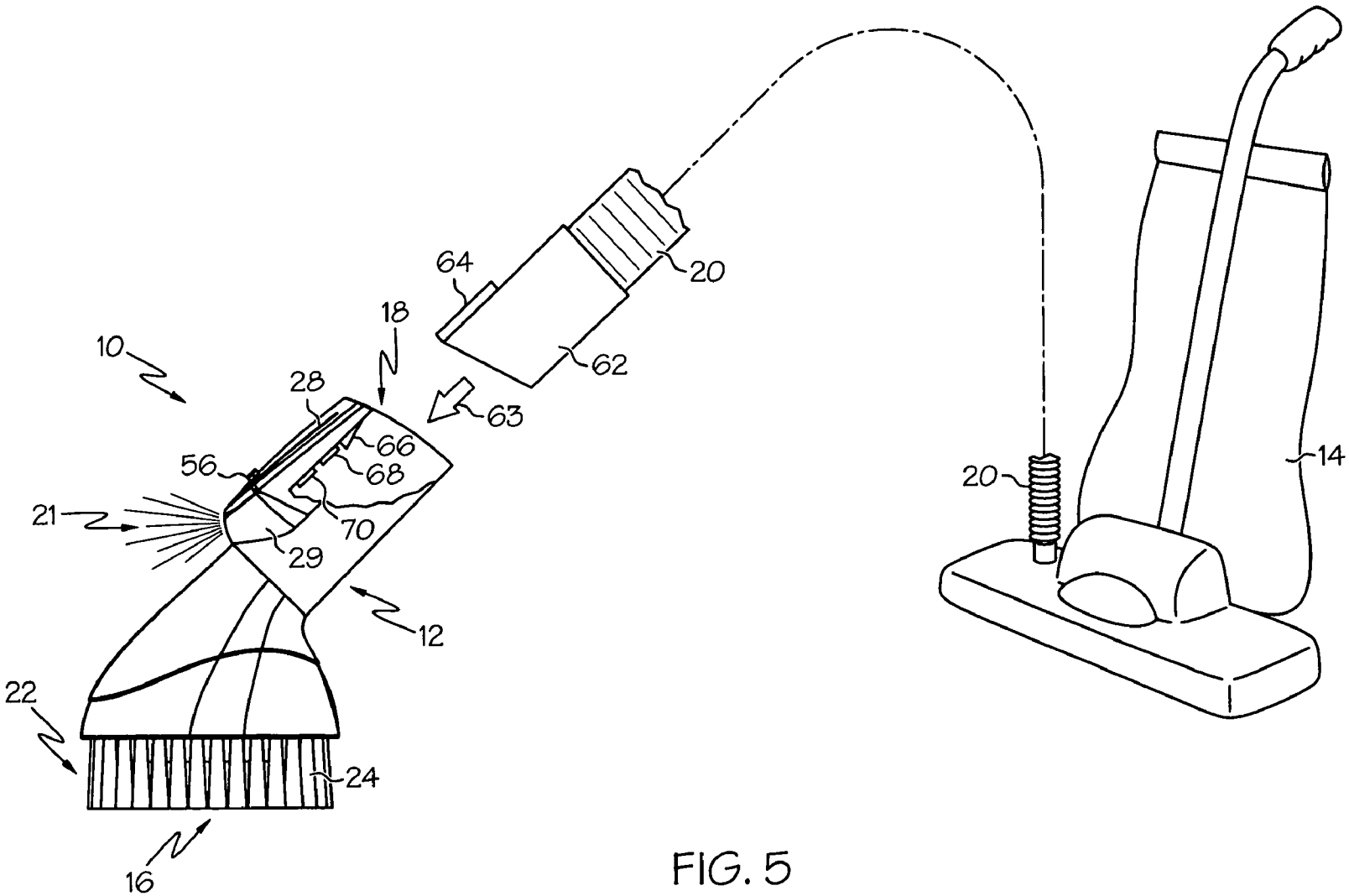
FIG. 5 is a side view of the example lighting apparatus of FIG. 1 showing how the cleaning attachment can be attached to an example hose of a vacuum cleaner.

Each lighting device 36 can be oriented in any manner. As shown in FIG. 5, for example, the light 21 emitted by the lighting device 36 can be oriented to provide illumination ahead of the cleaning attachment 12 and/or towards the lower portion 22, 22', 22". Further, at least one of the plurality of lighting devices 36 can be oriented at an angle with respect to the other lighting devices 36. As shown in FIG. 4A, each of the side LEDs 36 are angled away from the center LED 36 at an angle θ. Accordingly, while the center LED 36 can provide light along a central direction, each of the side LEDs 36 can provide light along angled directions to the right and left of center to provide light over a relatively large area. It is to be appreciated that the orientation of any lighting device 36 is not limited to a single axis, but that any lighting device 36 can be oriented at any angle along any and/or multiple axes. The lighting apparatus 10 can further include mounting structure 39 adapted to retain the lighting devices 36. As shown, the mounting structure 39 can comprise a single element adapted to retain all of the LEDs 36. Alternatively, the mounting structure 39 can comprise multiple elements each adapted to retain a particular number of LEDs 36 (e.g., to retain one or two LEDs). Further, as shown, the mounting structure 39 can be adapted to help orient the LEDs 36 at a particular angle.

As further shown in FIG. 4A, the lighting apparatus 10 can also comprise an electric circuit 40. As shown, the electric circuit 40 has a planar geometry having a top face 42 and a bottom face 44 (see FIG. 4B), though it is to be appreciated that the electric circuit 40 can have any geometry. The electric circuit can include a printed circuit board or any other structure adapted to operably connect the lighting devices 36 to other electric elements, such as a power source and/or a switching device. The electric circuit 40 can be adapted to attach to, and/or detach from, the cleaning attachment 12 and/or the housing 28. As shown, for example, the electric circuit 40 can attach to the cleaning attachment 12 by a threaded fastener 41, such as a screw or bolt, held in a mounting hole 43 disposed through the electric circuit 40. The threaded fastener 41 can then be received by corresponding threaded structure 45 of the cleaning attachment 12. In addition or alternatively, the electric circuit 40 can attach to the cleaning attachment 12 by an interference fit, a snap fit, or the like, or it can even be fixedly attached to the cleaning attachment 12, such as with an adhesive and/or welding process. Further, the cleaning attachment 12 can include alignment structure 47 adapted to ensure that the electric circuit 40 is properly aligned relative to the cleaning attachment 12. For example, the alignment structure 47 can include protrusions extending from, and/or indentations extending into, the surface of the cleaning attachment 12.

The electric circuit 40 can further include a battery 46. Additionally, a battery-mounting structure 48 can be operably connected to the electric circuit 40 to provide electrical current to the circuit 40. The battery-mounting structure 48 can be adapted to maintain the electrical connection between the battery 46 and the electric circuit 40. For example, the battery-mounting structure 48 can include a resilient portion 50 adapted to capture the battery 46 between the battery mounting structure 48 and a lip 52 attached to the electric circuit 40. As shown, the battery-mounting structure 48 is adapted to permit the battery 46 to be replaced when it can no longer provide sufficient electric current to power the lighting devices 10. In addition or alternatively, the battery could be permanently fixed to the electric circuit 40.

As shown, the battery 46 has a flat, cylindrical geometry, although the battery 46 can be of any type and/or configuration. Further still, the battery 46 could comprise a rechargeable battery. Accordingly, the electric circuit 40 could include battery charging elements (e.g., an external power connector and/or battery charging circuitry, not shown) adapted to charge the battery 46 while it remains connected to the electric circuit 40.

The electric circuit 40 can further comprise a switch 54 operably connected to the battery 46 and the lighting device 36 to regulate electric current between the battery 46 and the lighting device 36. The switch 54 can be of any type adapted to regulate the electric current between the battery 46 and the lighting device 36. As shown, for example, the switch 54 can include a normally-open electrical connection. Thus, when it is desired to permit electric current to flow between the battery 46 and the lighting device 36, a user can manipulate the switch 54 to close the electrical connection. Along the same lines, when it is desired to stop the electric current flow, a user can manipulate the switch 54 to open the electrical connection.

The switch 54 can comprise various configurations. As shown, for example, the switch 54 can comprise a push-button style of switch having an actuator 56 adapted to be pressed by a finger of a user (not shown). In addition or alternatively, the switch 54 can comprise other alternative configurations. For example, the switch 54 can comprise a toggle switch, an in-line switch, a rocker switch, or the like. Further, the switch 54 can comprise a biased switch having a resilient element (e.g., a spring or the like) adapted to return the actuator to a certain position after a user releases it. Further still, the switch 54 can comprise a momentary push-button switch adapted to open or close the switch 54 only when a user is actively manipulating the actuator 56. It is to be appreciated that the switch 54 can be disposed at various locations with respect to the cleaning attachment 12.

As shown in FIG. 4B, the lighting apparatus 10 can further comprise a timing device 58 adapted to deactivate the lighting device 36 after a predetermined amount of time after activation by the switch 54. That is, once the lighting device 36 has been activated, such as, for example, by a user actuating the switch 54, the timing device 58 is adapted to deactivate the lighting device 36 after a predetermined amount of time. The predetermined amount of time can be any amount of time. For example, if the predetermined amount of time is set at 10 minutes, then the timing device 58 will deactivate the lighting device 36 after 10 minutes have elapsed. It is to be appreciated that the timing device 58 can have a permanent or a variable predetermined time. For example, the timing device 58 can be permanently set to deactivate the lighting device 36 after 15 minutes have elapsed. Alternatively, the timing device 58 can have a variable predetermined time that can be set by a user. For example, a user may wish to first set the predetermined time to 5 minutes, and may later wish to set the predetermined time to 7, 10, 20 minutes, or other time interval. The predetermined or selected time interval can have various intervals.

The timing device 58 can comprise various timers of an analog and/or digital variety adapted to deactivate the lighting device 36 after a predetermined amount of time. For example, the timing device 58 can comprise a mechanical timer, or an electronic analog timer, such as a capacitor. In addition or alternatively, the timing device 58 can comprise a fully digital timer, such as in a solid state device. Further still, the lighting apparatus 10 can comprise a plurality of timing devices 58.

As a further example, the electric circuit 40 can comprise an integrated circuit 60. The integrated circuit 60 can include the timing device 58. For example, as shown, the integrated circuit 60 includes an electric timing device 58, such as an analog or digital electronic timing device. It is to be appreciated that the integrated circuit 60 is not required to include the timing device 58. For example, the integrated circuit 60 and the timing device 58 can each comprise separate electronic components operably connected to the electric circuit 40. Further still, the integrated circuit 60 can be operably connected to the switch 54 and/or the battery 46 to control the lighting device 36. It is to be appreciated that the electric circuit 40 can further include additional electronic components 61, as required.

The electric circuit 40 can also be adapted to provide additional functionality to the lighting apparatus 10. For example, the electric circuit 40 can be adapted to selectively control the amount of light provided by the lighting device 36. For example, the electric circuit can be adapted to provide variable amounts of electric current and/or voltage to the lighting device 36 to cause a greater or lesser amount of light 21 (see FIG. 5) to be emitted therefrom. In addition or alternatively, the electric circuit 40 can be adapted to selectively activate and/or deactivate one or more of a plurality of lighting devices 36. For example, the electric circuit 40 can be adapted to activate two of the LEDs 36 and deactivate one of the LEDs 36 to provide less light and an increased battery 46 life. Further still, the electric circuit 40 can be adapted to permit a user to selectively control the amount of light 21 emitted by the lighting device 36. For example, the electric circuit 40 can be adapted to permit a user to selectively activate or deactivate particular lighting devices 36, and/or control the amount of light 21 actually emitted by a particular lighting device 36. The electric circuit can include additional elements, such as electric components 60, switches (not shown), or the like, adapted to permit a user to select the level of emitted light 21.

It is also to be appreciated that the integrated circuit 60 can be adapted to provide the additional functionality, such as selective control of the amount of light provided by the lighting device 36. For example, the integrated circuit 60 can be adapted to differentiate and/or interpret various actuation sequences of the switch 54, such as quick taps, long holds, or any combination thereof, to increase or decrease the amount of light. In addition or alternatively, the integrated circuit 60 can be adapted to receive input from additional elements, such as electric components 60, switches (not shown), or the like, to selectively control the amount of light 21 (see FIG. 5) emitted by the lighting devices 36.

Turning now to the example shown in FIG. 5, the lighting apparatus 10 can further comprise a vacuum cleaner 14 having a hose 20. The electric circuit 40 can be adapted to activate the lighting device 36 automatically upon attachment of the cleaning attachment 12 to the hose 20. As shown, the hose 20 can include an end 62 adapted to be received by the vacuum outlet 18 of the cleaning attachment 12 (e.g., by inserting the end 62 into the vacuum outlet 18 in the direction of arrow 63). Any mechanism can be used to automatically activate the lighting device 36 upon attachment of the cleaning attachment 12 to the hose 20. For example, the end 62 of the hose 20 can include a projection 64 adapted to engage a switch 66 located within the vacuum outlet 18. As shown, for example, the switch 66 can be resiliently biased to an open position and can include a ramped geometry adapted to engage the projection 64 of the hose end 62 as it is inserted into the vacuum outlet 18. It is to be appreciated that the timing device 56 can still deactivate the lighting device 36 after a predetermine amount of time, even though the hose 20 may still be attached to the cleaning attachment 12. It is also to be appreciated that the lighting apparatus 10 can include one, or both, of the switches 54 and 66.

In addition or alternatively, another switch 68 can be adapted to activate the lighting device 36 automatically upon attachment of the cleaning attachment 12 to the hose 20. The switch 68 can be a contact switch adapted to interact with structure of the hose 20 (e.g., projection 64, or the like), as discussed above, or it can include various other types of switches. For example, the switch 68 can include a sensor such as a proximity sensor switch or photo-sensor switch, or other sensor. As an additional example, the switch 68 can include a pressure sensor located within the vacuum outlet 18 that is adapted to activate the lighting device 36 when a decrease in pressure is sensed, such as when the vacuum motor (not shown) of the vacuum cleaner 14 is activated.

It is to be appreciated that while various types of switches 68 can be used to activate the lighting device 36, the lighting apparatus 10 can still comprise a timing device 58 adapted to deactivate the lighting device 36 after a predetermined amount of time after activation by the switch 68. In addition to the switch 68, the electric circuit 40 can further comprise a second switch, such as the aforementioned switch 56, operably connected to the battery 46 and the lighting device 36 that is adapted to permit a user to selectively re-activate the lighting device 36 after deactivation by the timing device 36. For example, a user may wish to use the cleaning attachment 12 for a time period greater than the predetermined time setting of the timing device 36. That is, for example, once the switch 66 and/or 68 has automatically activated the lighting device 36, and the timing device 36 has subsequently deactivated the lighting device 36 after a predetermined amount of time, a user can be permitted to re-activate the lighting device 36 by use of the second switch. The timing device 36 can be adapted to interact with the re-activation sequence, as well. Thus, once reactivated by the second switch, the timing device 36 may deactivate the lighting device after a predetermined amount of time. It is to be appreciated that the second switch can be similar in form and/or function of the switch 56 and may even comprise the switch 56 as previously described herein.

Further still, the electric circuit 40 can be adapted to deactivate the lighting device 36 automatically when the cleaning attachment 12 is detached from the hose 20. For example, where a contact-type switch 66 is used, the act of removing the hose end 62 from the vacuum outlet 18 can disengage the projection 64 from the switch 66. As an additional example, if the switch 68 comprises a photo-sensing switch 68, the act of removing the hose end 62 from the vacuum outlet 18 can permit the photo-sensing switch 68 to sense an increase in the lighting conditions.

In addition or alternatively, the electric circuit 40 can further comprise a sensor 70 adapted to sense a variety of conditions. For example, the sensor 70 can sense when the hose end 62 is attached to the cleaning attachment 12, or when the vacuum motor (not shown) has been activated. The sensor 70 can comprise various types of sensors, such as, for example, a photo-sensor, a pressure sensor, a thermal sensor, an electromagnetic sensor, flow sensor, proximity sensor, and/or acoustical sensor. It is to be appreciated that the electric circuit 40 can comprise a plurality of sensors 70, or even a combination sensor 70 adapted to sense multiple conditions (e.g., a photo and a pressure sensor). It is to be appreciated that the sensor 70 can be disposed in various locations on the cleaning attachment 12.

As discussed above, the electric circuit 40 can be adapted to activate the lighting device 36 automatically upon attachment of the cleaning attachment 12 to the hose 20. Thus, for example, the electric circuit 40 can be adapted to activate the lighting device 36 automatically when the sensor 70 senses a particular condition, such as a lighting condition (e.g., a decrease in the lighting condition caused by insertion of the hose end 20 into the vacuum outlet 18) or a pressure condition (e.g., activation of the suction motor of the vacuum cleaner 14). Additionally, the sensor 70 can be used in conjunction with any of the switches 56, 66, 68 and/or the timing device 36 to activate and/or deactivate the lighting device 36 automatically. For example, the electric circuit 40 can be adapted to activate the lighting device 36 automatically upon a combination of events, such as the actuation of the switch 66 and the sensing of a pressure drop by a pressure sensor 70 (e.g., the hose end 62 is inserted into the vacuum outlet 18 and the suction motor (not shown) of the vacuum cleaner 14 is activated). Thus, if the user has turned off the suction motor (not shown) of the vacuum cleaner 14, and the timing device 58 deactivates the lighting device 36 after a predetermined amount of time, the electric circuit 40 will not re-activate the lighting device 36 until the sensor 70 (e.g., pressure sensor) senses further operation of the vacuum motor. The battery 46 life can thereby be preserved by ensuring that the lighting device 36 is not in use when the user is not using the vacuum cleaner 14.

The invention has been described with reference to the preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A lighting apparatus for a vacuum cleaner, comprising:
- a cleaning attachment;
- a housing adapted to attach to the cleaning attachment;
- at least one lighting device adapted to be received by the housing; and
- an electric circuit adapted to be received by the housing, the electric circuit comprising
  - a battery,
  - a switch operably connected to the battery and the lighting device to regulate electric current between the battery and the lighting device, and
  - a timing device adapted to deactivate the lighting device after a predetermined amount of time after activation by the switch.

2. The lighting apparatus of claim 1, wherein the lighting device comprises a light emitting diode (LED).

3. The lighting apparatus of claim 1, further comprising a light permeable cover.

4. The lighting apparatus of claim 3, wherein the light permeable cover comprises a lens adapted to direct a portion of the light emitted by the lighting device.

5. The lighting apparatus of claim 1, wherein the at least one lighting device comprises a plurality of lighting devices.

6. The lighting apparatus of claim 5, wherein at least one of the plurality of lighting devices is oriented at an angle with respect to another one of the lighting devices.

7. The lighting apparatus of claim 1, further comprising a plurality of bristles removably attached to the cleaning attachment.

* * * * *